United States Patent [19]

Cliff et al.

[11] Patent Number: 4,513,547

[45] Date of Patent: Apr. 30, 1985

[54] MULTI-PURPOSE ELEVATED WATER STORAGE FACILITIES

[75] Inventors: John O. Cliff, Franklin; James Edwards, Nashville, both of Tenn.

[73] Assignee: Pittsburgh-Des Moines Corporation, Pittsburgh, Pa.

[21] Appl. No.: 416,681

[22] Filed: Sep. 10, 1982

[51] Int. Cl.[3] ..... E04H 7/04; E04H 14/00

[52] U.S. Cl. ..... 52/194; 52/236.3

[58] Field of Search ..... 52/194, 192, 235, 236.3

[56] References Cited

U.S. PATENT DOCUMENTS

| | | | |
|---|---|---|---|
| D. 91,508 | 2/1934 | Blackburn . | |
| D. 118,935 | 2/1940 | Green . | |
| 1,913,174 | 6/1933 | Stephenson | 52/247 |
| 1,947,515 | 2/1934 | Blackburn | 52/194 |
| 1,971,342 | 8/1934 | Goldsby | 52/194 |
| 2,567,958 | 9/1951 | Mummert | 52/194 |
| 2,715,953 | 8/1955 | Marrow . | |
| 3,295,265 | 1/1967 | Hida | 52/236.2 |
| 3,685,228 | 8/1972 | Pauley | 52/235 |
| 3,916,587 | 11/1975 | Cox | 52/192 |
| 4,202,147 | 5/1980 | Krogh . | |
| 4,232,495 | 11/1980 | Lin et al. | 52/245 |
| 4,313,457 | 2/1982 | Cliff | 137/312 |
| 4,327,531 | 5/1982 | Cazaly et al. | 52/194 |

FOREIGN PATENT DOCUMENTS

| | | | |
|---|---|---|---|
| 344569 | 11/1936 | Italy | 52/236 |
| 574513 | 9/1977 | U.S.S.R. | 52/194 |

OTHER PUBLICATIONS

Engineering News Record; Jul. 29, 1943; pp. 68–71.

"Hydro Pillar"; Pittsburgh–Des Moines Steel Co.; Apr. 1971.

*Primary Examiner*—Donald G. Kelly

*Assistant Examiner*—Michael Safavi

*Attorney, Agent, or Firm*—Shoemaker and Mattare, Ltd.

[57] ABSTRACT

An elevated water storage facility includes a fluted pillar which is divided into a plurality of levels so the facility is multi-purpose. One embodiment of the facility includes an outer wall surrounding the pillar.

9 Claims, 14 Drawing Figures

MULTI-PURPOSE ELEVATED WATER STORAGE FACILITIES

BACKGROUND OF THE INVENTION

The present invention relates in general to elevated water storage facilities, and, more particularly, to multi-use elevated water storage facilities.

Elevated water storage facilities encompass vast areas of usable space. To make maximum use of such space, the assignee of the present invention manufactures such facilities which include means for dividing the space beneath the elevated tank into a plurality of floors. An example of such facilities disclosed in U.S. patent application Ser. No. 168,808, filed on July 11, 1980. The disclosure of such patent application is incorporated herein by reference thereto.

As use of such multi-purpose structures increases, more aesthetically pleasing structures are required. Furthermore, adaptation of existing structures is also required to make such existing structures more aesthetically pleasing.

SUMMARY OF THE INVENTION

The multi-purpose elevated water storage facility of the present invention includes a fluted pillar supporting the elevated tank, thereby rendering the overall facility more efficient and aesthetically pleasing.

Furthermore, the facility can include an additional outer wall surrounding the central pillar to render the facility even more aesthetically pleasing. Such outer wall can be retrofit, if desired.

OBJECTS OF THE INVENTION

It is, therefore, an object of the present invention to make a multi-purpose elevated water storage facility extremely aesthetically pleasing.

This together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
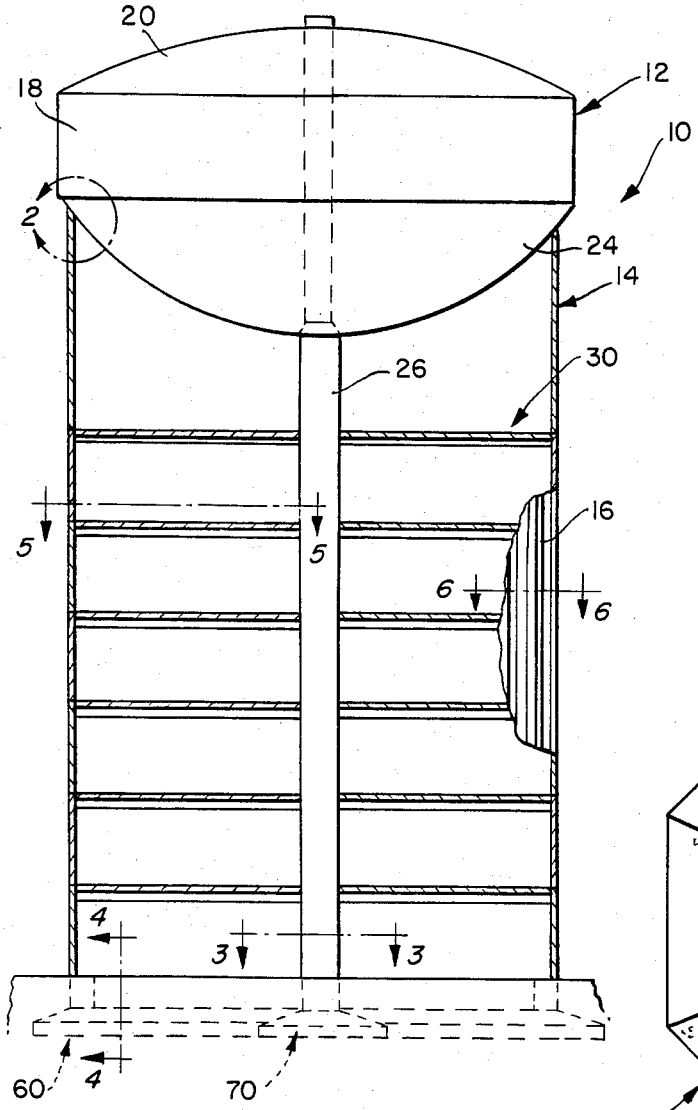
FIG. 1 is an elevation view of an elevated water storage facility embodying the teachings to the present invention.

Shown in FIG. 1 is an elevated water storage facility 10 which includes an elevated water storage tank 12 supported by a pillar 14 having flutes 16 thereon. The tank occupies substantially all of the top cross-sectional area of the pillar and includes a cylindrical portion 18, an arcuate top 20 and an arcuate bottom portion 24. A riser 26 is also included, as is other means necessary to conduct water from the facility to users, some of whom may be located at great distances from the facility. The fluted pillar thus serves as an exterior wall of the facility.

Figure 5:
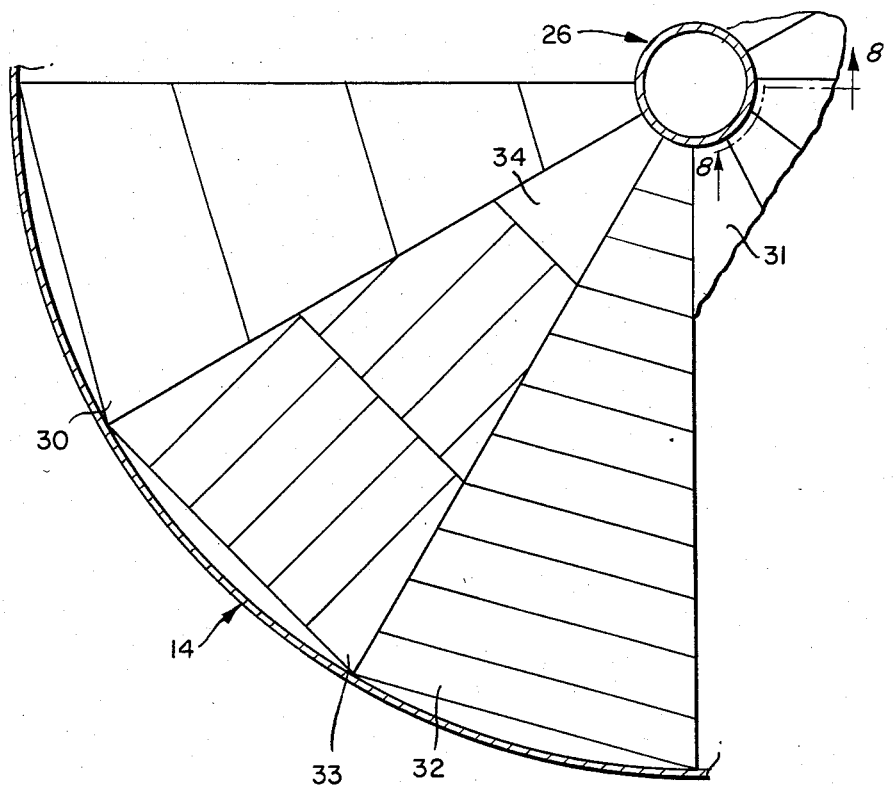
FIG. 5 is a plan view taken along line 5—5 of FIG. 1.
Figure 6:
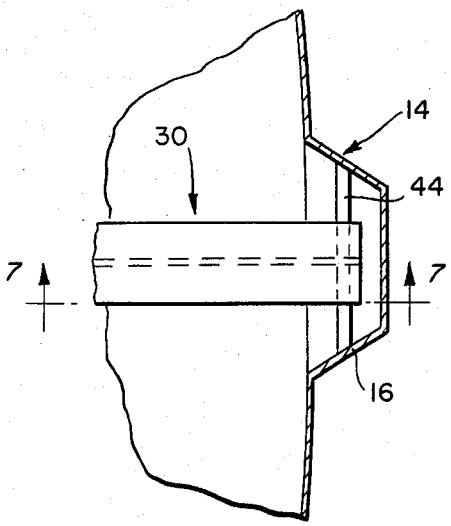
FIG. 6 is a plan view taken along line 6—6 of FIG. 1.
Figure 8:
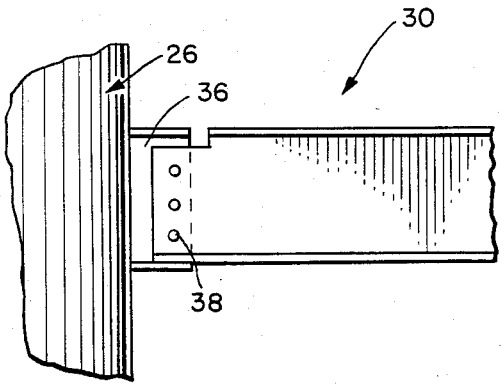
FIG. 8 is an elevation view taken along line 8—8 of FIG. 5.
Figure 7:
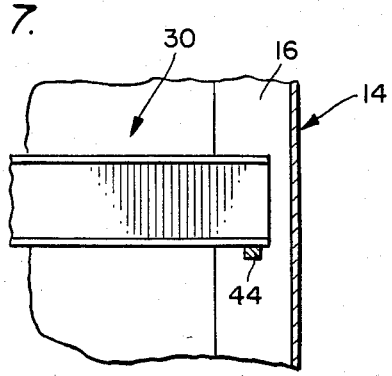
FIG. 7 is an elevation view taken along line 7—7 of FIG. 6.

A plurality of floors 30 are included so the facility 10 is multi-purpose and also serves as usable space for offices, storage, or the like. A floor is shown in FIGS. 5–8 and includes a multiplicity of panels 31–34 and is mounted on the riser by mounting brackets, such as bracket 36, by fasteners, such as bolts 38, or the like. The fluting of the pillar accommodates the floor, and a floor framing system is shown in FIG. 5, while FIGS. 6 and 7 show the intersection of a floor and the pillar with support bars, such as bar 44, mounting the floor to the pillar at the flutes.

Figure 2:
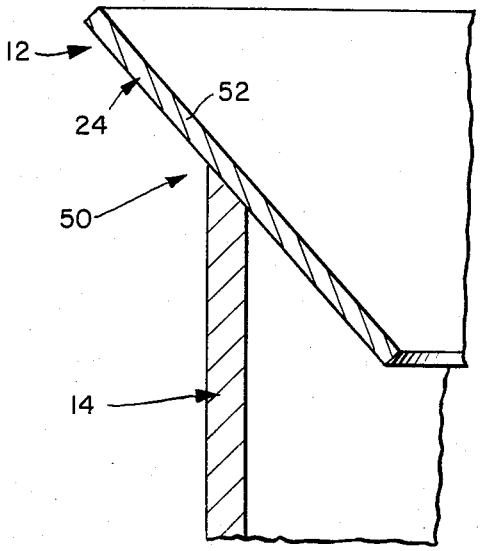
FIG. 2 is an elevation view taken along line 2—2 of FIG. 1.

The pillar 14 bears the load of the tank 12 and the contacts thereof. The intersection 50 of the pillar and the tank is shown in FIG. 2 and occurs beneath the cylindrical portion of the tank. Preferably, $2\frac{1}{4}$ inch thick cone plates 52 are mounted at a 30° angle on the top of the pillar 14.

Figure 4:
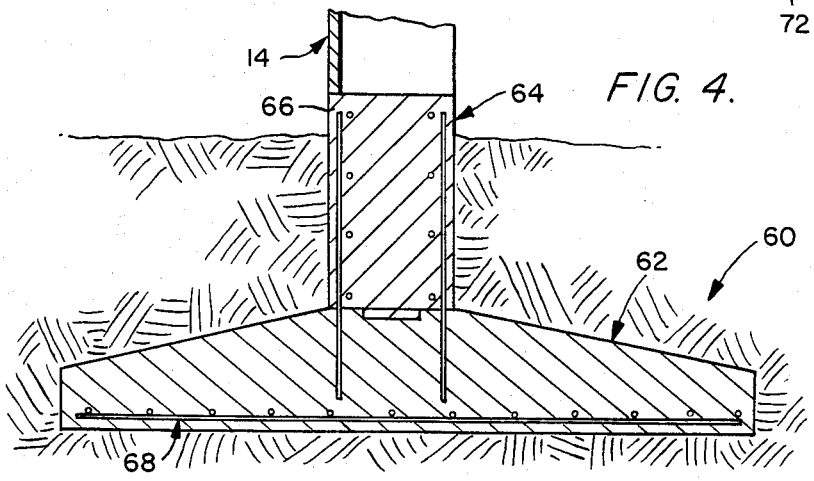
FIG. 4 is an elevation view taken along line 4—4 of FIG. 1.

Th pillar wall is supported on a foundation 60 best shown in FIG. 4 as including a spread base 62 and a wall supporting portion 64 having a sleeve 66 thereon. Strengthening means 68 is also included in the foundation 60 and can be located as shown in FIG. 4, or at other positions on that foundation.

Figure 3:
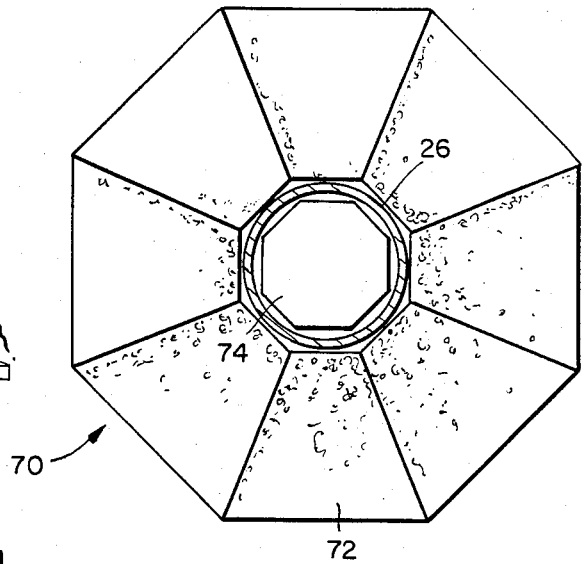
FIG. 3 is a plan view taken along line 3—3 of FIG. 1.

The riser 26 is supported by an octagonal foundation 70 best shown in FIG. 3. The foundation 70 includes a base 72 and a supporting portion 74.

The elevated storage facility 10 is further discussed in the above-referenced co-pending patent application, Ser. No. 168,808.

Figure 9:
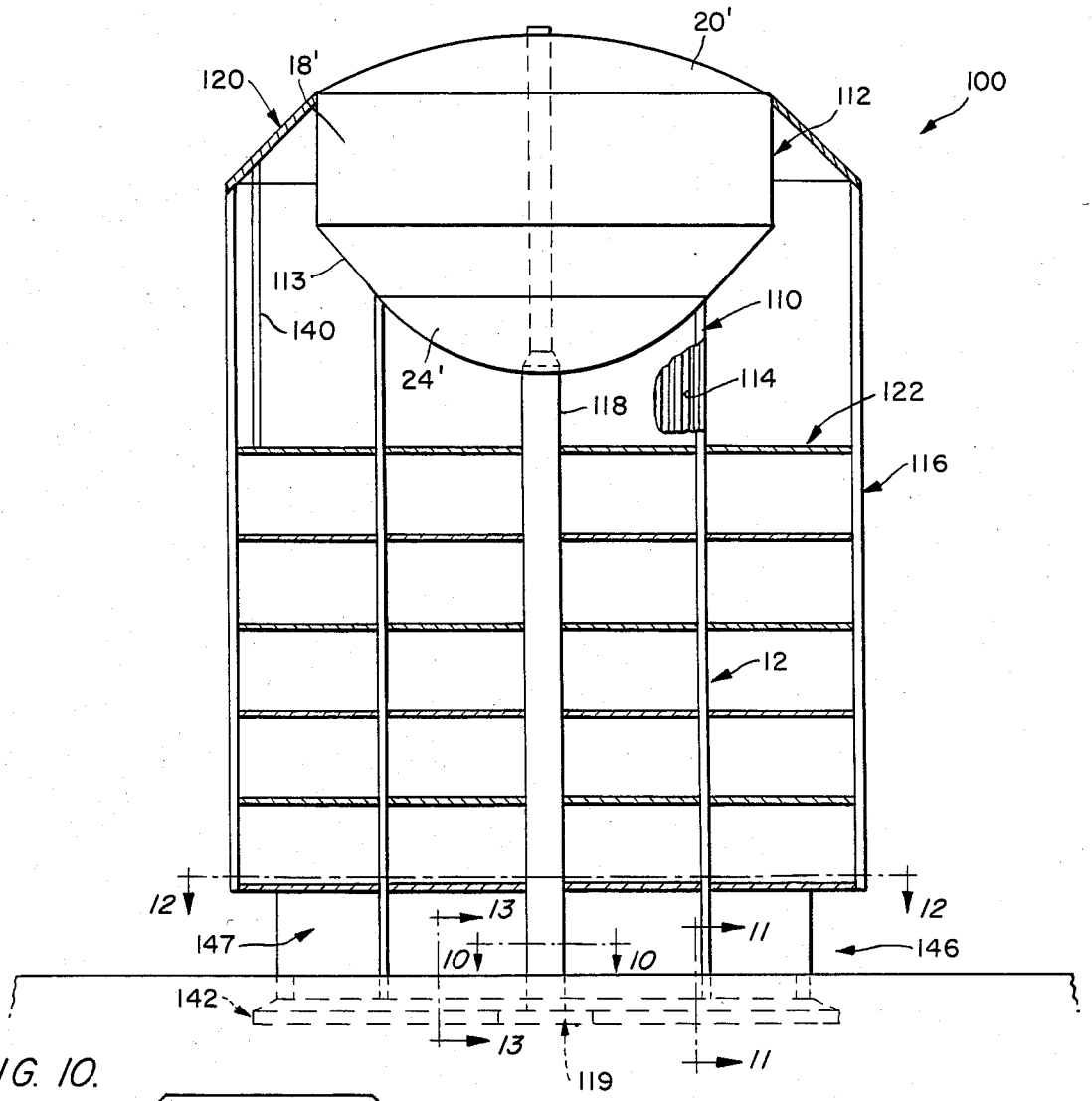
FIG. 9 is an elevation view of an alternative embodiment of an elevated water storage facility embodying the teachings of the present invention.
Figure 10:
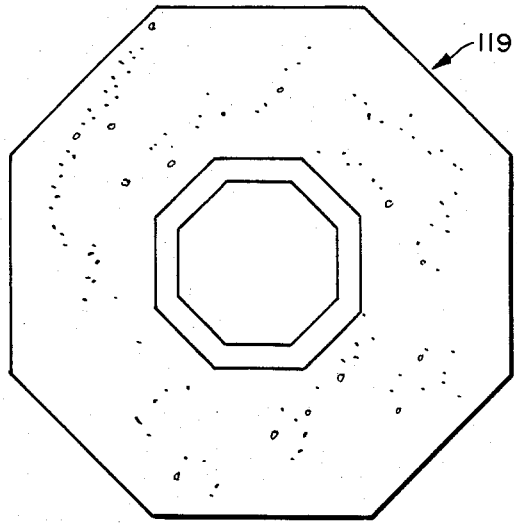
FIG. 10 is a plan view taken along line 10—10 of FIG. 9.
Figure 13:
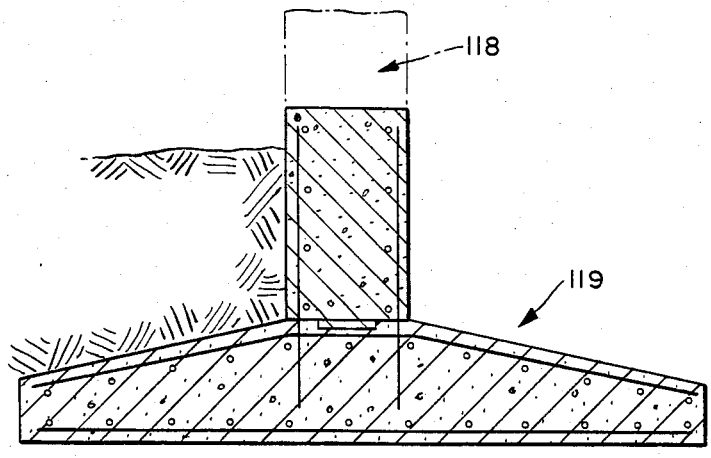
FIG. 13 is an elevation view taken along line 13—13 of FIG. 9.

Shown in FIG. 9 is an elevated storage facility 100 which includes a load bearing core 110 supporting a tank 112 thereon. The facility 100 includes water delivery means as discussed above, and a conical portion 113 connecting cylindrical portion 18' to bottom portion 24'. A top portion 20' is also included in the tank. The core can be fluted as indicated at area 114 if so desired, and is surrounded by a wall 116, which can be a curtain wall construction if suitable. The core 110 includes a riser 118 having an octagonal foundation 119 shown in FIGS. 10 and 13, and can include a pillar 12 such as discussed above, and thus the tank and core of the facility 100 can be formed of the facility 10 if suitable. Retrofitting can accomplish such result, and can also be used to form facility 100 from other facilities.

A roof portion 120 connects the outer wall 116 to the tank top portion 20'. The facility 100 also includes a plurality of floors, such as floor 122. The pillar wall is supported on a foundation which can be similar to the foundation 60 discussed above. Elevators, and the like equipment, can also be included as desired.

The pillars in either facility 10 or facility 100 can be concrete, if desired.

Figure 11:
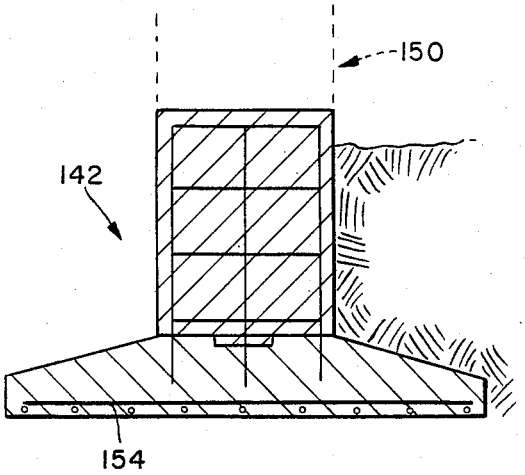
FIG. 11 is a plan view taken along line 11—11 of FIG. 9.
Figure 12:
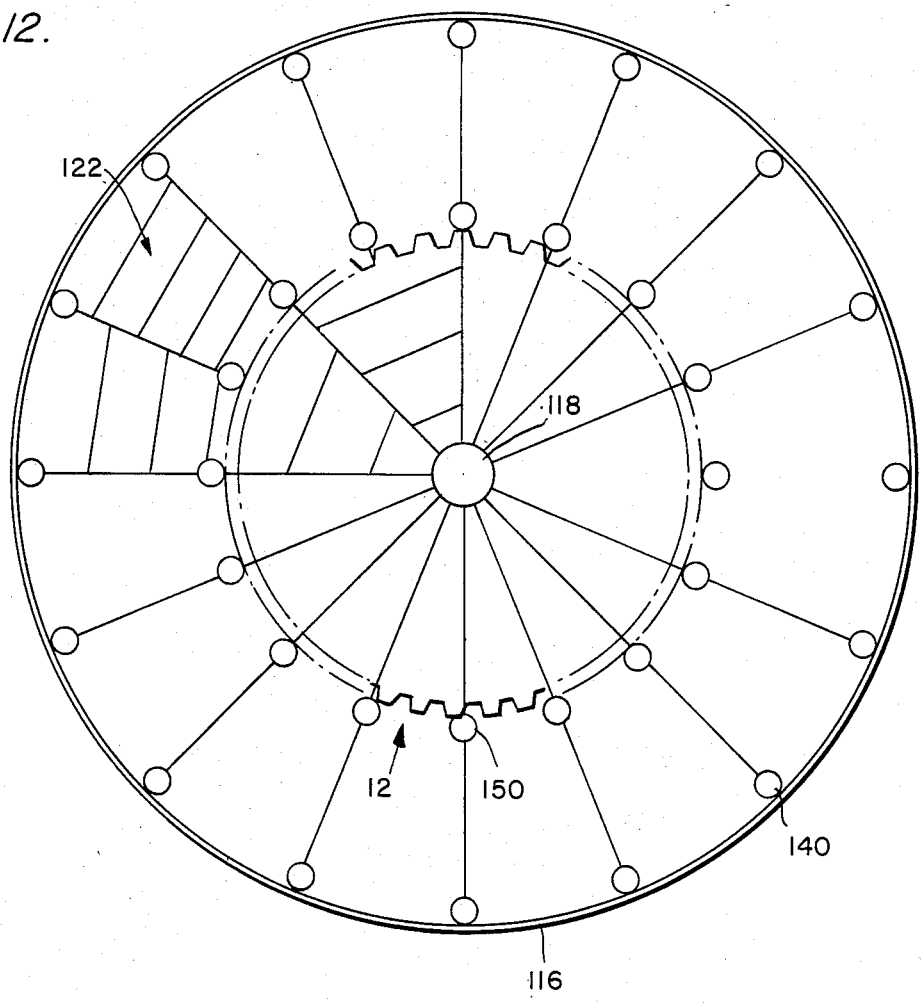
FIG. 12 is a plan view taken along line 12—12 of FIG. 9.

As shown in FIG. 12, a plurality of columns, such as column 140, are located immediately adjacent to and interior of the exterior wall 116. The pillar 110 (FIG. 9) is supported on foundations, such as foundation 142 shown in FIG. 11, and which is similar to the foundation 60 shown in FIG. 4. The columns 140 support floor 145 beams for the floors between the exterior wall 116 and the core 110. Preferably, there are sixteen of these columns 140. As shown in FIG. 9, the ground floor 146 is unenclosed with access areas 147 or the like includable as suitable. The columns 140 terminate at the first floor level radial beams, and additional support columns 150 (shown in FIG. 12) can be located immediately adjacent to and exterior of the pillar. The vertical columns 150 are supported on foundations similar to the foundation 142 shown in FIG. 11. As shown in FIG. 12, radial first floor beams 145 support at their exterior ends the columns 140 and are supported at their interior ends by riser 118 and approximately mid-way by the vertical columns 150. The foundation 142 includes strengthening means 154, as discussed above.

Figure 14:
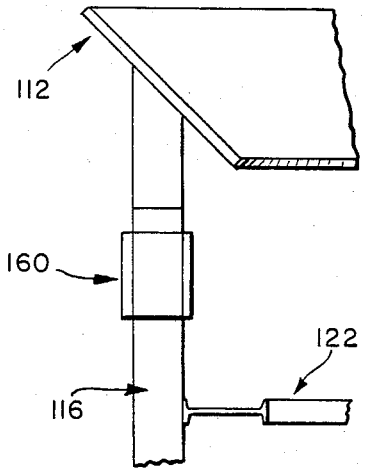
FIG. 14 is an elevation view showing an intersection between a support pillar and an elevated water storage tank.

Shown in FIG. 14 is a manhole 160 located in the interior wall 114 just beneath the tank 112.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. An improvement in a multi-story elevated water storage facility comprising: an elevated water storage tank supported on a pillar and occupying substantially all of the top cross-sectional area of the pillar, means fluidly connected to the storage tank for distributing water from the tank to a user located outside the area immediately adjacent to the pillar, the facility having dividing means dividing the pillar into a plurality of levels beneath the tank to define a multi-story building which is located in an elevated water storage tank structure so that a single structure serves as both an elevated water storage facility and a multi-story building, said pillar forming a load bearing core for the water storage tank, a wall exterior to and surrounding the pillar and extending over substantially the full height of the facility, second dividing means dividing the volume defined by said exterior wall into a plurality of levels, the lowermost second dividing means being at a predetermined distance above a foundation level so that an overhang recess portion exists between the outside wall and the foundation level, and said pillar bearing the load of the water storage tank thereon by thick cone plates affixed at an angle on the top of the pillar.

2. The improvement of claim 1 wherein the exterior wall and second dividing means are added to an existing elevated water storage facility.

3. The improvement of claim 1 wherein at least some of the second dividing means are located at substantially the same elevations as the first dividing means.

4. The improvement of claim 3 wherein the lowermost second dividing means is at a predetermined distance above a foundation level so that an overhang recess portion exists between the outside wall and the foundation level.

5. The improvement defined in claim 1, wherein said dividing means comprises a plurality of floors, each floor having a multiplicity of panels, and support means including support bars horizontally across selected pillar wall flutes for supporting one end of each floor by the pillar.

6. The improvement defined in claim 5, wherein a riser is provided within the pillar extending between the center bottom of the water storage tank and a foundation base, said riser having means therewith for supporting the other end of each floor.

7. The improvement definded in claim 6, wherein said floor supporting means with the riser includes brackets fixed thereto, and each respective other end of each floor being bolted thereto.

8. The improvement defined in claim 7, wherein said pillar wall is supported at ground level upon a foundation having a spread base with reinforcing means provided therewith.

9. The improvement defined in claim 1, further including a roof between the top of the water storage tank and the exterior wall.

* * * * *